United States Patent [19]

Lavon

[11] 4,141,592

[45] Feb. 27, 1979

[54] METHOD AND DEVICE FOR BREAKING HARD COMPACT MATERIAL

[75] Inventor: Erik V. Lavon, Saltsjo-Boö, Sweden

[73] Assignee: Atlas Copco Aktiebolag, Nacka, Sweden

[21] Appl. No.: 724,691

[22] Filed: Sep. 17, 1976

[30] Foreign Application Priority Data

Sep. 19, 1975 [SE] Sweden ..... 7510557

[51] Int. Cl.[2] ..... E21C 37/06

[52] U.S. Cl. ..... 299/16

[58] Field of Search ..... 299/13, 16, 18, 10, 299/20, 21, 22; 102/22

[56] References Cited

U.S. PATENT DOCUMENTS

| | | | |
|---|---|---|---|
| 3,960,082 | 1/1976 | Sloevsky | 299/13 |
| 3,964,792 | 6/1976 | Archibald | 299/18 X |
| 3,988,037 | 10/1976 | Denisart et al. | 299/16 |

FOREIGN PATENT DOCUMENTS

| | | | |
|---|---|---|---|
| 20445 of | 1912 | United Kingdom | 102/22 |
| 868700 | 5/1961 | United Kingdom | 299/16 |

*Primary Examiner*—William Pate, III

*Attorney, Agent, or Firm*—Flynn & Frishauf

[57] ABSTRACT

A hard compact material, such as rock, is broken by maintaining a column of relatively incompressible fluid, such as water, extending from outside into at least one hole which has been pre-drilled in the material to be broken. A shock wave is generated in the column outside the hole and is transmitted through the column into the hole. Due to the energy of the propagated shock wave, cracks are initiated and driven to a free surface of the material to break same. Breakage by the effect of the shock wave may be facilitated by means of an explosive. The explosive is delivered into the hole prior to the admission of fluid thereinto and is initiated by means of the transmitted shock wave.

14 Claims, 9 Drawing Figures

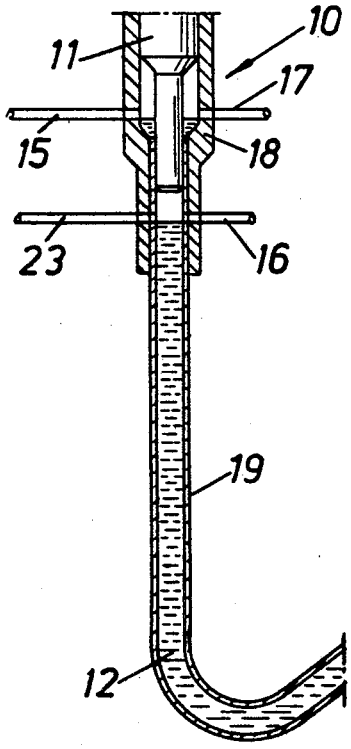
Fig. 2
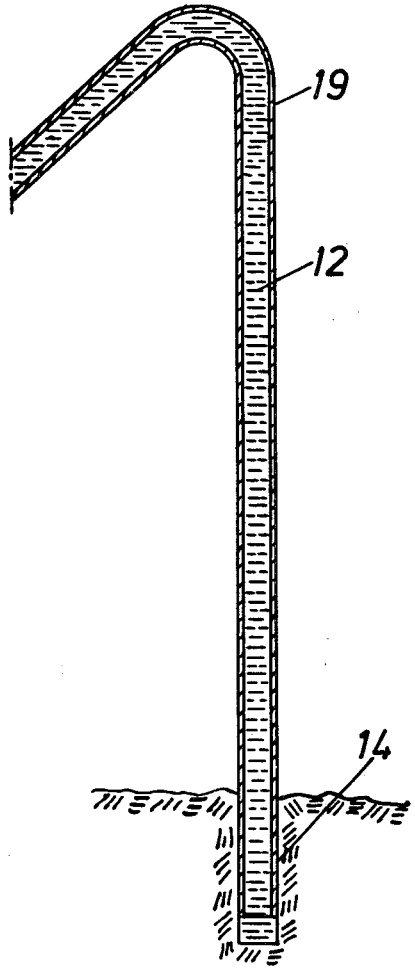

38

53
39
10
23
16

VIII
VIII
37
IX
IX
46
48
47
49
50
51
52
53
40
41
42
43
44
45

METHOD AND DEVICE FOR BREAKING HARD COMPACT MATERIAL

The invention relates to a method and device for breaking a hard compact material, such as rock, wherein at least one hole is drilled in the material to be broken and the hole is filled with relatively incompressible fluid, such as water. The fluid is pressurized causing cracks to form directly or indirectly in the material.

BACKGROUND OF THE INVENTION

Conventional methods of rock breakage, including drilling-and-blasting, ripping and crushing have several disadvantages.

The conventional drill-and-blast technique has the disadvantage of noise, gases, dust and flying debris, which means that both men and machines must be evacuated from the working face. Further disadvantages of the drill-and-blast technique are overbreak, which entails costly reinforcement of the tunnel wall in certain cases, and the obvious danger of storing and handling explosives in a confined working space.

Conventional crushing techniques are also inefficient in that the the rock is made to fail in compression whereas it is weaker and would fail more easily in tension. Consequently, as a result of the large forces required to crush the rock, tool wear is significant, particularly in hard or abrasive rocks.

During the last decade serious attention has been given to replacing the drill and blast techniques for tunnelling, mining and similar operations. One alternative technique involves the use of high velocity jets of water or other liquid to fracture the rock or ore body and numerous devices intended to produce pulsed or intermittent liquid jets of sufficiently high velocity to fracture even the hardest rock have been suggested. Devices of that type are disclosed in for example U.S. Pat. Nos. 3,784,103 and 3,796,371. As yet, however, jet cutting techniques are still unable to compete with the traditional methods of rock breakage such as drill and blast in terms of advance rate, energy consumption or overall cost. Moreover serious technical problems such as the fatigue of parts subjected to pressures as high as 10 or 20 kbar and excessive operational noise remain.

A second, and even older technique for fracturing the rock and for saturating soft rock formations such as coal with water for dust suppression involves drilling a hole in the rock and thereafter pressurizing the hole with water. This technique is disclosed in for example German Pat. No. 230,082. Low pressure water is continuously delivered into the hole for filling the pores adjacent to the hole, thereby suppressing dust and improving the function of the hole as a pressure water cylinder. When a desired degree of massiveness is obtained the water delivery, i.e. the mass transport, into the hole is increased stepwise. The coal stope cannot absorb this suddenly supplied large amount of water which means that a breaking force arises. The method is inapplicable to hard rock formations because of the restriction in working pressure which can be realized or usefully utilized with conventional hydraulic pumps. It is also difficult to apply in practice in soft crumbling rock or badly fissured rock.

SUMMARY OF THE INVENTION

It is an object of the invention to provide a hydraulic breaking technique where the energy required for breakage comprises shock wave energy. This energy is transmitted to the material by means of shock waves which are generated outside the hole and propagate through a fluid column. The conditions which must be fulfilled are that neither sharp turns nor sudden changes of area exist in the column. Such turns and area changes cause great losses which means that the amount of energy which act in the hole is far too small to obtain breakage.

It is another object of the invention to facilitate the breakage by means of an explosive. The explosive is initiated by means of the propagated shock wave. In this case the breaking energy comprises the chemical energy of the explosive and the energy of the shock wave.

It is to be understood that the term "fluid" used in the claims means a substance that alters its shape in response to any force, that tends to flow or to conform to the outline of its container, and that includes liquids, plastic materials and mixtures of solids and liquids capable of flow.

The invention is described in the following description with reference to the accompanying drawings in which various embodiments are shown by way of example. It is to be understood that these embodiments are only illustrative of the invention and that various modifications thereof may be made within the scope of the claims following hereinafter.

BRIEF DESCRIPTION OF THE DRAWINGS

In the drawings,

FIGS. 2 and 3 show in section alternative embodiments of and apparatus according to the invention.

Corresponding details have been given the same reference numeral in the various figures.

In FIG. 1 is shown an impactor or accelerating device designated generally 10. The impactor 10 comprises an impact piston 11 which is arranged to impinge against the rear end face of a fluid column 12. In the illustrated embodiment the fluid column 12 consists of water; however, other fluids can be used. The fluid column 12 is confined within a barrel 13 which extends between the impactor 10 and a blind hole 14 pre-drilled in a hard compact material, such as rock. The hole 14 is drilled by using conventional technique. Fluid is delivered to the barrel 13 through a conduit 23. The fluid level is maintained constant by means of a passage 16. In front of the impact piston 11 is arranged a hydraulic cushioning chamber 18 which retards the impact piston and absorbs its surplus kinetic energy when cracks are caused to form spreading out from the hole 14 and the fluid level in the barrel 13 is lowered. Fluid is supplied to the cushioning chamber 18 through a passage 15. The level in the cushioning chamber is maintained constant by means of a passage 17.

Figure 1:
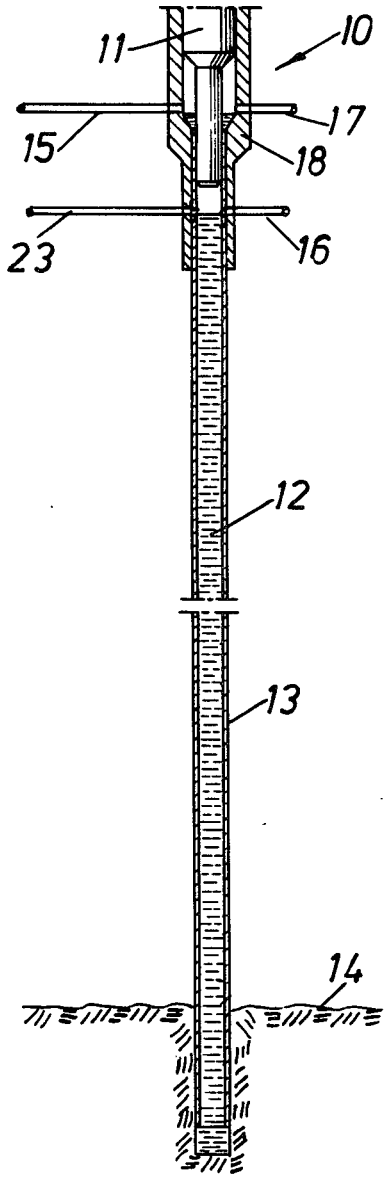
FIG. 1 is a sectional side view of an apparatus according to the invention.

When the impact piston 11 hits the fluid column 12 a pressure is generated therein in form of a shock wave which propagates at the local velocity sound through the fluid column downwards the drill hole.

During the first moment of the retardation of the impact piston the amplitude p of the shock wave, i.e. the pressure, can be represented as $$p = v\,\rho_2 c_2 / (1 + \rho_2 c_2/\rho_1 c_1)$$

where v is the impact velocity of the piston, $\rho_1$ is the density of the piston, $\rho_2$ is the density of the fluid column, $c_1$ is the sound velocity in the piston, and $c_2$ is the sound velocity in the fluid column.

At the instant when the impact is delivered also a compressive wave arises in the impact piston; this compressive wave propagates at the velocity $c_1$ from the surface of impact in a direction opposite to the direction of movement of the piston. The compressive wave is reflected as a tensile wave in the rear free end of the piston; this tensile wave reaches the partition surface between piston and fluid column after the time $T = 2L_1/C_1$, where $L_1$ is the length of the impact piston and the time T is measured from the time of impingement.

After being reduced by the reduction facto $2/(1 + \rho_1 c_1/\rho_2 c_2)$ the tensile wave is transmitted into the fluid and is superposed upon the compressive wave which is propagating into the fluid since the instant when the impact is delivered. The net result is that the pressure is reduced by the fact $(1 - \rho_2 c_2/\rho_1 c_1) / (1 + \rho_2 c_2/\rho_1 c_1)$ from the arrival onwards of the first wave which is reflected in the piston.

The amount of the energy in the above tensile wave which is not transmitted into the fluid is reflected backwards in the piston as a repeated compressive wave having an amplitude equal with the one which now exists in the fluid nearest to the partition surface. The reason why the amplitude of the compressive wave gets this value depends upon the fact that equilibrium of forces must exist in the partition surface all the time. After a repeated reflection in the rear end of the piston with changing of sign a repeated reduction of the pressure by the above factor occurs in the partition surface between piston and fluid. This course continues until the entire kinetic energy of the impact piston is consumed.

When studying what happens when the shock or compressive wave generated in the fluid column arrives in the bottom of the drill hole it is to be found that as long as the material adjacent thereto stands firm, the shock wave is reflected as a shock wave having the same amplitude. Because arriving and reflected wave are superposed upon each other the pressure becomes doubled. On the assumption that no losses occur during the passage through the fluid column there is thus instantaneously generated a pressure $p = 2\,v\rho_2 c_2 / (1 + \rho_2 c_2/\rho_1 c_1)$.

If the impact piston is made of steel and the fluid consists of water the amount of the factor $\rho_2 c_2/\rho_1 c_1$ is 1/26. This factor can be overlooked in the denominator of the above expression which means that the pressure can be written $p \doteq 2\,v\rho_2 c_2$.

The above discussion is applicable if the fluid column is so long when compared to the impact piston that the compressive wave which is reflected from the bottom of the drill hole does not reach the impact piston and interfere with the shock wave generating process which goes on there. In other case a repeated reflection occurs causing increase of pressure which means that the continued course is difficult to calculate with the above theory.

The last case can instead be dealt with if the fluid column is considered to be a spring having no mass which means that the same pressure can be assumed to exist at the same time in the whole fluid column.

If the primary kinetic energy of the piston is set to be equal to the maximum resilience energy of the fluid, the pressure $P_{max} = V\rho_2 C_2\sqrt{L_1\rho_1 / L_2\rho_2}$ is obtained.

For the combination steel piston - water column this expression approximately is $P_{max} = 2.8\,V\rho_2 C_2 \sqrt{L_1 / L_2}$.

In practise transmission losses always exist in proportion to the length of the fluid column. Thus, if the length of the fluid column is 15 piston lengths, the pressure level of the first portion of the compressive wave can be estimated to decrease 5 to 10 percent on its way to the drill hole.

Further, the losses are influenced by the material in the barrel or tube which encloses the fluid column such that a soft material causes larger losses than a harder material.

The impactor 10 can be driven hydraulically, pneumatically or by combustion. The only essential feature is that it must be able to accelerate the impact piston 11 to a velocity which is required to generate a sufficiently powerful shock wave when the piston impinges against the column. The impact piston 11 shown in FIG. 1 is combustion driven in a mode known per se. In FIG. 1 the piston is shown in its initial position. If another type of drive is chosen a longer acceleration space is required.

In tests with an equipment referred to further on in the specification in connection with performed experiments it has been found that, at the dimensions in question there, a shock wave having an amplitude in the order of 750 bar is required to cause cracks to form in hard rock. If the impact piston is made of steel and the column 12 consists of water it is then necessary to accelerate the impact piston to a velocity of about 50 meters per second before it reaches the column 12. A characterizing feature of the method according to the invention is then that the impact piston impinges directly against the column 12. The fluid column 12, thus, is free backwards.

When the invention is reduced to practice it is usually desired that the cracks are initiated at the bottom of the hole and that they are propagating therefrom so as to loosen as much material as possible.

In this connection, however, two difficulties exist. If the material is of uniform strength and if the hole is made without sharp-edged bottom and corners which cause local stress concentration, then cracks will be initiated accidentally in the hole over the whole sphere of action of the pressure. The cracks which are closest to the mouth of the hole will thereafter be able to propagate easiest since the thinner the material layer between the crack and the mouth of the hole is the less force is required for deformation. The result is that breaking from the full depth of the hole cannot be obtained.

This difficulty could possibly be overcome by making the hole such that the transition between bottom and wall of the hole becomes so sharp that a local stress concentration is obtained which means that cracks would be initiated at and propagated from this zone upon pressurization. The condition precedent for this is that the material for the rest is homogenous and equal in strength. However, that is seldom the case in practice and particularly not at rock breaking, where the occurrence of older naturally occurring cracks disturb the process.

One way of avoiding these two difficulties is to insert the barrel or tube into the hole to about at least the half depth thereof. The propagation of the cracks which are in the vicinity of the bottom of the hole then take precedence since the fluid has to turn and overcome a flow resistance before it can reach the cracks which are outside the mouth of the tube. Such a mode of breaking is illustrated in FIG. 2 which shows an embodiment of the invention wherein the fluid column 12 is guided through a flexible tube or hose 19. The transmission of energy is carried out by means of shock waves which are propagating through the stationary fluid column. This means that the fluid column can be oriented substantially arbitrarily between the impactor and the drill hole provided that there do not exist too sharp turns which cause losses. In order not to cause losses the fluid column also should be made without sudden changes of area. When the equipment according to FIGS. 1 and 2 are dimensioned there must be taken into consideration the time during which the shock wave generated by the impact piston 11 has to act in the drill hole 14 in order to cause cracks to form and propagate toward a free surface so that complete loosening occurs. The weight of the piston 11, the amount of water in the column, the elasticity of the material in the hose and the impact velocity of the piston against the column have effect upon this time. In practise the most suitable values of the above factors at breaking of different materials are found experimentally.

If the above dimensioning rule is taken into consideration the material in the piston can be chosen arbitrarily. As typical materials can be mentioned steel, rubber, plastics, wood and water. Further, the depth of the blind hole 14 or the distance between the hole and a free surface at bench breaking must be chosen with respect to the shockwave energy transmitted into the hole so that this energy is sufficient to initiate and drive the cracks to the nearest free surface at crater breaking and bench breaking respectively.

The form of the hole can also affect the result in as much as if stress concentration exist the cracks are initiated at these portions.

Figure 3:
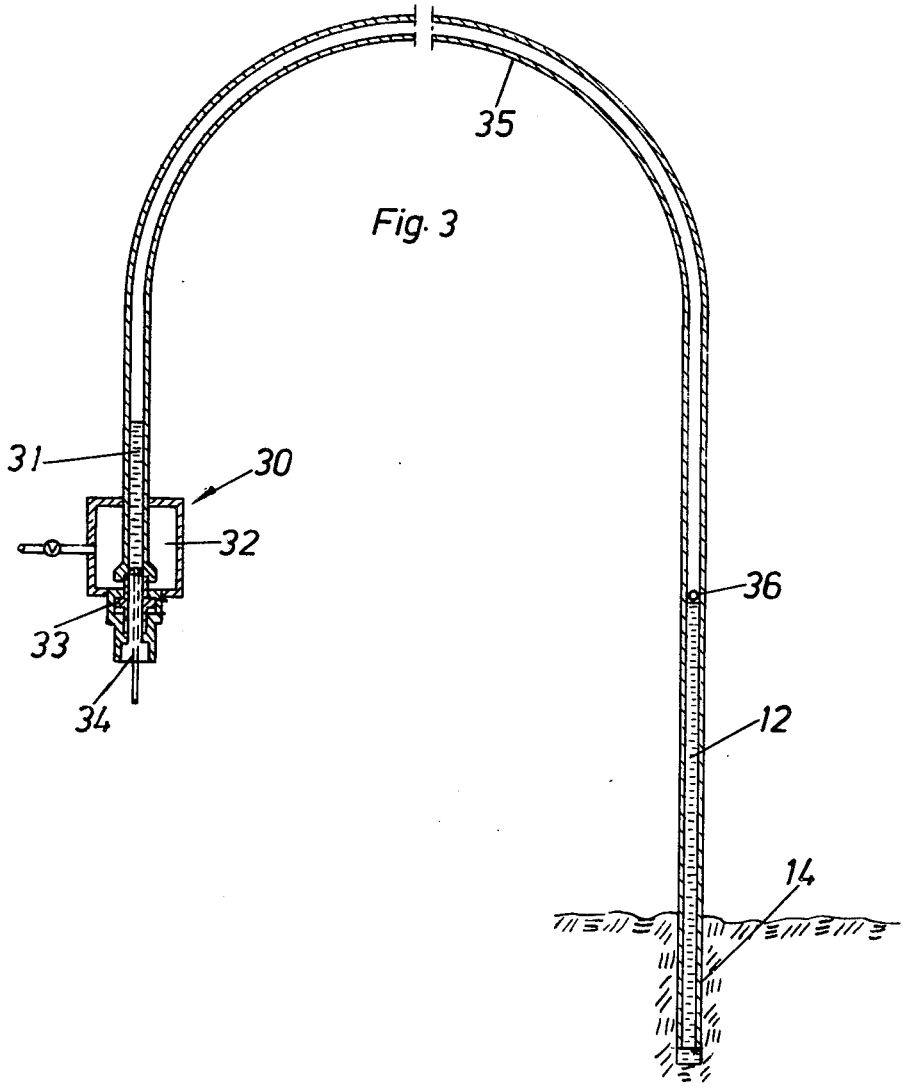

In FIG. 3 is shown another embodment of an apparatus according to the invention. An accelerating device generally depicted 30 is arranged to accelerate a fluid piston or body 31 toward a fluid column 12 in the hole 14. The fluid column extends through a tube or hose 35 from the bottom of the hole 14 to a venting hole 36 in the hose 35. The fluid piston 31 consists of water, other fluids, however, can be used. The fluid is filled through a passage 34. By shifting a valve 33 pressure gas confined in a chamber 32 is caused to act upon the fluid piston 31, thereby accelerating the fluid piston toward the fluid column 12. When the fluid piston 31 impinges the fluid column 12 a shock wave is generated therein which is transmitted through the column into the drill hole 14. The hose or tube 35 can of course, as shown in FIG. 1, be straight. If the hose 35 is curved then the end of the hose which is inserted into the hole of course must be anchored so as to take up the forces of inertia produced during the propulsion of the piston 31. The necessary anchorage can be obtained by connecting the forward end of the hose to a conventional hydraulic boom. The hose is mounted on the boom in such way that it projects past the boom a distance corresponding to the length of the hose which is intended to be inserted into the drill hole. The drill boom is forced against the rock surface such that the urging force exceeds the force of reaction acting on the hose during the propulsion of the fluid piston.

Figure 4:
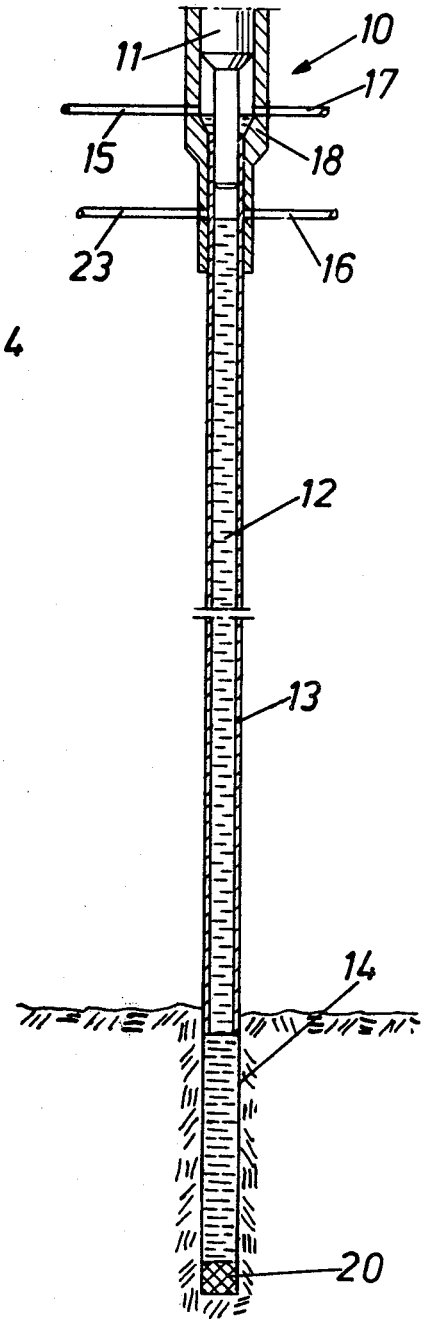
FIG. 4 shows in section the apparatus in FIG. 1 in an alternative mode of operation.

According to a development of the inventive concept the energy of the shock wave generated by the impact piston piston 11 can be used to initiate an explosive which is delivered into the hole 14. In FIG. 4 an explosive 20 is delievered into the hole 14 before the tube 13 is filled with fluid. In this case is the smallest applicable length of the piston defined by the time during which the pressure required for initiation has to act upon the explosive in order to obtain detonation. Of course can also the apparatus shown in FIGS. 2 and 3 be used for initiation of an explosive delivered into the hole 14. The explosive can be delivered into the hole in suitable manner. Particularly can the impactor or accelerating device 10; 30 be designed such that the explosive is brought into the tube 13; 19; 35 through a feed conduit, not shown. The explosive is then delivered into the hole by means of the fluid supplied through the passage 23; 34.

At the detonation the portion of the fluid column 12 which is within the drill hole 14 will provide a stemming which seals the hole, thereby preventing the generated detonation gases as well as the explosive from leaking past the stem, which thus contributes to a maximum bursting effect. Upon the detonation a return wave is generated in the tube 13. Therefore the tube must be dimensioned to withstand the further increase of pressure which then arises.

The energy which is set free in the hole and which is made use of for the breakage of the material is composed by two components, namely the chemical energy of the explosive and the energy of the shock wave. The latter is a valuable additional contribution of energy to the blasting process and that means that the amount of explosive can be reduced when compared to conventional blasting. Besides a better overall blasting effect seems to arise due to the fact that the stem is a fluid which fills the produced cracks and delays the leakage of the blasting gases to the surrounding before complete breakage is caused.

Figure 5:
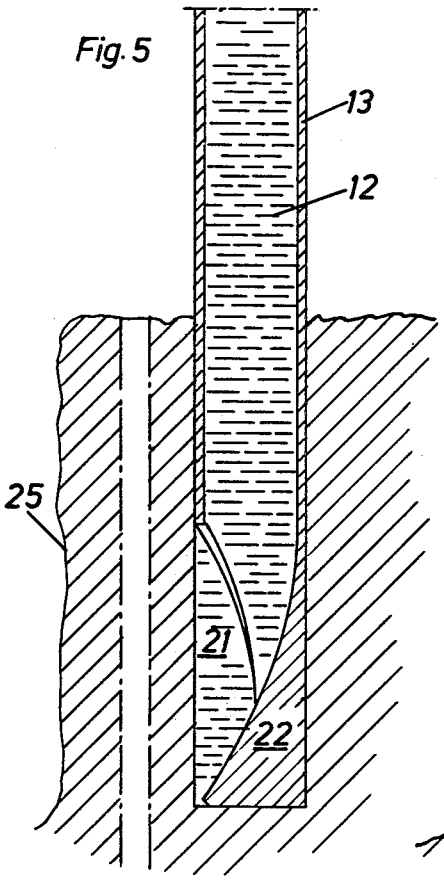
FIGS. 5 and 6 show alternative embodiments of a barrel inserted into a drill hole in an apparatus according to the invention.

FIG. 5 shows an embodiment of the tube or barrel 13 (or the hose 20) where a directed fracture or break effect is acheived. Directed fracture may be applied advantageously when the breaking is carried out as bench blasting where break occurs toward a free surface 25 in the bench. The barrel 13 is partly cut off at its forward end to provide a sidewards directed outlet opening 21. The side of the tube 13 opposed to the outlet opening 21 is designed as a deflector plug 22. In conformity with the mode of operation where the barrel is inserted into the hole the propagation of cracks takes precedence in the direction where the outlet opening points. The outlet opening is thus directed towards the free surface against which break is desired. This provides more efficient use of the energy of the shock wave. The device in FIG. 5 can also be used for breaking orebodies which are located in comparatively thin layers. Long-holes are drilled parallel with the free surface 25 from crosscuts. The tube 13 is successively inserted stepwise into the long-hole and breakage is caused after each stepped insertion of the tube.

Figure 6:
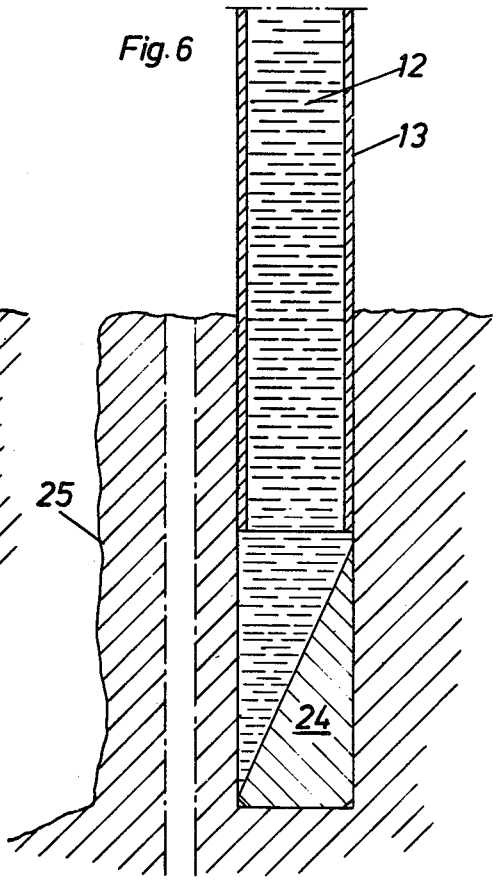

FIG. 6 illustrates an alternative embodment for obtaining directed fracture effect toward the surface 25. Instead of being integrally united with the barrel 13 the deflector plug is designed as a separate unit 24 which is inserted into the hole before the barrel 13.

The device shown in FIG. 5 may be modified in different ways for obtaining fracture effect in desired direction. By omitting the plug 22 propagation of cracks takes precedence downwards as well as sidewards due to the opening 21. By arranging several openings around the periphery of the barrel 31 fracture effect is obtained in an optional number of directions.

The invention may also be applied advantageously to obtain delay interval breaking. The optimum time interval between breakage in two consecutive holes, having the best fragmentation of rock in mind, is directly proportional to the burden. By giving the fluid columns mutually varying lengths from the impactor which is common to a plurality of holes the shock waves generated at the impingment of the impact piston will cause pressure forces which act with mutual time delay in the respective hole.

Figures 7, 8, 9:
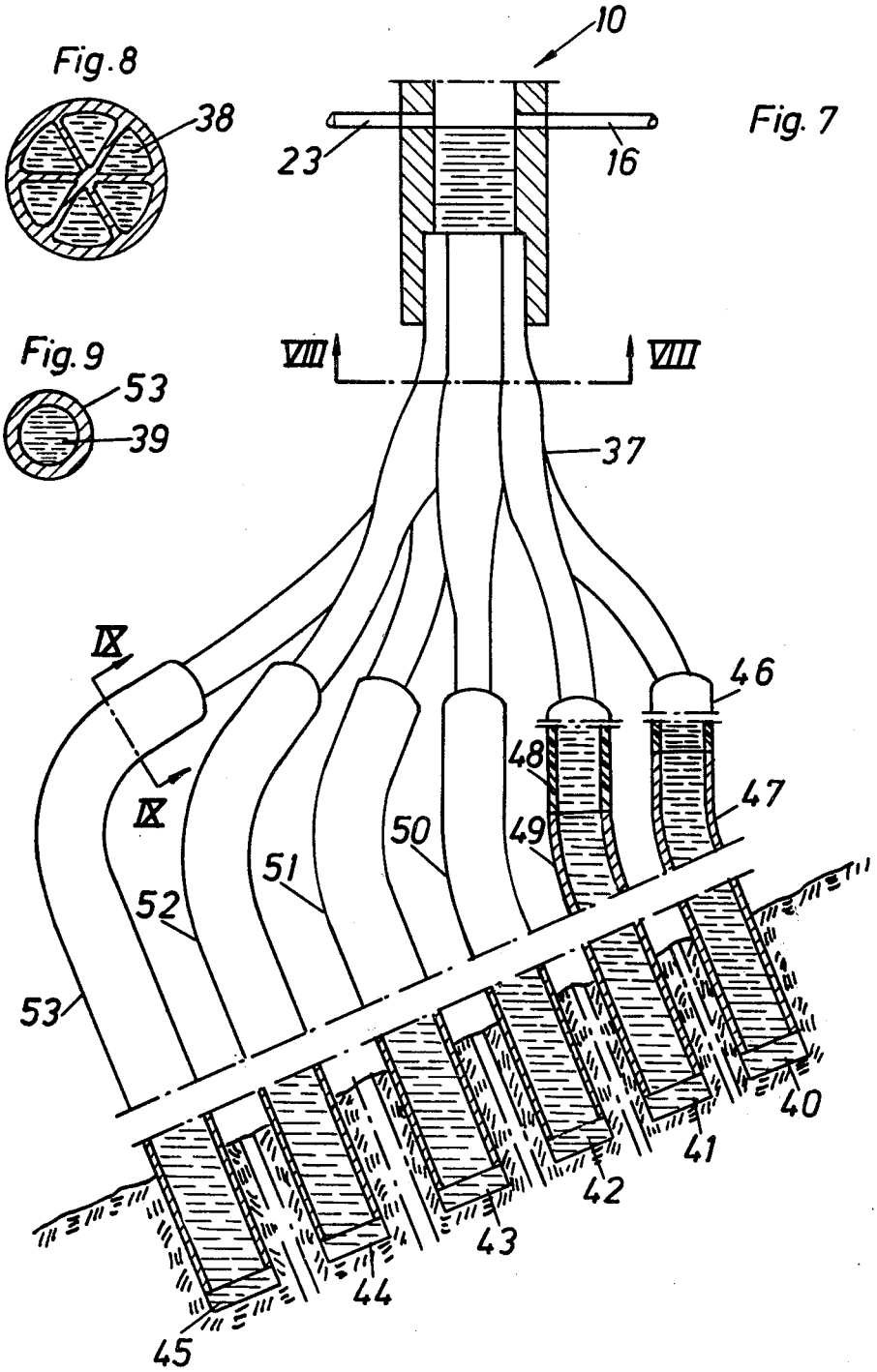
FIGS. 7-9 illustrate how delay interval breaking is achieved by an apparatus according to the invention.

FIGS. 7–9 show a device for obtaining delay interval breaking. In FIG. 7 there are six pre-drilled blind holes 40–45. Hoses or tubes 46–53 are inserted into each of these holes. A branching 37 is provided between the hoses and their common impactor 10. The hoses between the branching and the holes 40, 41 are of equal length and illustrate how a desired time delay can be obtained by suitable choice of the material in the conduits between the impactor and the drill holes. In a completely non-flexible tube the shock wave is propagated at the sound velocity of the medium in the tube. If the tube or hose is flexibly yielding radially a lower propagating velocity of the shock wave is obtained. The velocity, of course, becomes lower the more elastic the material is. It is also possible to affect the velocity of the shock wave by making the tube or hose of different material in different portions of its length and by varying the mutual length of these portions. The portion 46, 48 of the respective hose which is closest to the branching is made of an elastic material, such as rubber or plastics, and the other portion 47, 49 is made of a substantially non-elastic material, such as steel. As shown in FIG. 7 the portion 46 is shorter than the portion 48.

The hoses 50–53 illustrate how the time delay can be obtained by mutually varying the lengths. The mutual length of the hoses increases continuously between two consecutive adjacent holes in such way that the hose 50 is shortest and the hose 53 longest. FIGS. 8 and 9 illustrate that the inner area 38 of each of the passages in the branching 37 is of equal size as the inner area 39 of the hoses 50–53. If the area is constant all the way between the impactor and the holes the effect to the time delay caused by varying area is eliminated.

The fact that the impact body 11; 31 in the illustrated embodiments impinges directly against the fluid column does of course not preclude the possibility of encapsulating the column. Further, the column can be bounded by a plastic plug, a membrane or the like. The column does not need to be made of solely one material but can be designed as a compound column.

In the illustrated embodiments the shock wave is generated by mechanical impacts against the fluid column. However, when found suitable, the shock wave can be generated in other ways. The shock wave can for example be generated by spark discharge in the fluid column of electric energy accumulated in a capacitor or by causing an explosive in the fluid column to detonate.

Several experiments have been made according to the invention. In one experiment a device shown in FIG. 1 was used. The diameter of the barrel 13 was 32 mm. A 200 mm deep hole was drilled vertically in the rock. The length of the water column 12 was about 1 meter. A steel piston 11 was launched against the column 12. Crater blasting was carried out and the cracks were initiated at the bottom of the hole.

What I claim is:

1. A method of breaking a hard compact material, such as rock, in which at least one hole is pre-drilled, comprising:

maintaining a column (12) of substantially incompressible fluid having a length which exceeds the hole depth, filling the free cross sectional area of the hole with fluid at the one end of said column which directly contacts a surface of the hole.

accelerating an impact body toward said fluid column by means of an accelerating device to impact said fluid column and generate a shock wave in said column outside the hole, said impact body having a shorter length than that of said column, and transmitting the shock wave through said column into the hole to act directly on a surface of the hole, said shock wave having a sufficient amplitude to cause cracks to form in the material, said fluid column being of sufficient length with respect to the length of said impact body for preventing a pressure increase caused by occurring shock wave reflections from arising in said column outside said hole.

2. A method according to claim 1 comprising maintaining said fluid column (12) in a tube (13; 19; 25) which extends between said accelerating device (10; 30) and the hole and wherein said impact body is accelerated coaxially with said tube.

3. A method according to claim 2 comprising maintaining said fluid column (12) in a flexible hose (19; 35).

4. A method according to claim 1 comprising deflecting the shock wave at least partially in the hole laterally with respect to the longitudinal direction of the hole.

5. A method according to claim 1, wherein several holes are pre-drilled in the material to be broken comprising maintaining respective fluid column (12) between a common accelerating device (10; 30) and each of the holes, and said fluid columns having mutually varying length so that the shock waves transmitted therethrough reach respective hole with respective mutual time delay interval breaking.

6. A method according to claim 1 wherein several holes are pre-drilled in the material to be broken, comprising maintaining respective fluid columns (12) in tubes or hoses (13; 19; 35) between a common accelerating device (10; 30) and each of the holes, and said tubes or hoses having mutually varying radial elasticity so that the shock waves transmitted through said respective fluid columns reach respective holes with respective mutual time delays for obtaining delay interval breaking.

7. Method according to claim 1 comprising maintaining said column of fluid in a resilient hose.

8. Method according to claim 1 comprising maintaining said column of fluid in a radially yielding elastic hose.

9. A method according to claim 1, comprising maintaining free the end of said column which is most rearward in a direction away from and out of the hole, and accelerating said impact body to directly impact the free rearward end of said column.

10. A method according to claim 1, in which said column has no sudden substantial changes of cross sectional area or direction which would cause substantial shock wave energy losses.

11. A method of breaking a hard compact material, such as rock, in which at least one hole is pre-drilled, comprising:

maintaining a column of substantially incompressible fluid having a length which exceeds the hole depth, filling the free cross section area of the hole with fluid at the one end of said column which directly contacts a surface of the hole, accelerating an impact body toward said fluid column by means of an accelerating device to impact said fluid column and generate a shock wave therein outside the hole, said impact body having a shorter length than that of said column, said length being chosen so as to create a pressure-time history in the vicinity of the bottom of the hole such that the pressure is highest when the shock wave arrives in the bottom of the hole, whereupon the pressure thereafter decreases, and transmitting the shock wave through said column into the hole to act directly on a surface of the hole, said shock wave having a sufficient amplitude to cause cracks to form in the material.

12. A method according to claim 11, comprising maintaining free the end of said column which is most rearward in a direction away from and out of the hole, and accelerating said impact body to directly impact the free rearward end of said column.

13. A method according to claim 11, in which said column has no sudden substantial changes of cross sectional area or direction which would cause substantial shock wave energy losses.

14. An apparatus for breaking a hard compact material such as rock, having a plurality of pre-drilled holes formed therein, comprising:

a plurality of barrel means (13; 19; 35) adapted to be inserted into the respective holes, each of said barrel means having a length which exceeds the hole depth and each of said barrel means having respective mutually varying radial elasticities, means for filling the free cross sectional area of the hole with relatively incompressible fluid and for maintaining a column (12) of the fluid extending rearwardly out of the hole inside said barrel means, an accelerating device associated with said barrel means, said accelerating device having an impact piston which impinges against the fluid column in said barrel means for generating shock wave energy in said column of a magnitude which exceeds that required to cause cracks to form in the material, said impact piston having a shorter length than that of said column, each of said barrel means extending between said means for generating shock wave energy and a respective one of said plurality of pre-drilled holes, and said barrel means defining a wave-guide for the propagating shock wave to transmit the generated shock wave energy to act directly on a surface of the hole with sufficient magnitude for causing cracks to form in the material, said wave-guide having a length relative to the length of said impact piston which is sufficient for preventing a pressure increase caused by occurring shock wave reflections from arising in said column outside said hole.

* * * * *

UNITED STATES PATENT AND TRADEMARK OFFICE

CERTIFICATE OF CORRECTION

PATENT NO. : 4,141,592

DATED : February 27, 1979

INVENTOR(S) : Erik V. LAVON

It is certified that error appears in the above-identified patent and that said Letters Patent are hereby corrected as shown below:

Column 2, line 67, after "velocity", insert --of--;

Column 8, line 47, change "hole" to --holes--;

Column 8, line 48, after "delay" insert --for obtaining delay--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*